US006485541B1

(12) United States Patent
Hryn et al.

(10) Patent No.: US 6,485,541 B1
(45) Date of Patent: Nov. 26, 2002

(54) METHOD TO DECREASE LOSS OF ALUMINUM AND MAGNESIUM MELTS

(75) Inventors: John N. Hryn; Michael J. Pellin, both of Naperville; Wallis F. Calaway, Jr., Woodridge; Jerry F. Moore, Naperville; Gregory K. Krumdick, Crete, all of IL (US)

(73) Assignee: The University of Chicago, Chicago, IL (US)

( * ) Notice: Subject to any disclaimer, the term of this patent is extended or adjusted under 35 U.S.C. 154(b) by 0 days.

(21) Appl. No.: 09/632,873

(22) Filed: Aug. 4, 2000

(51) Int. Cl.[7] ..... C22B 9/00; C22B 26/00; C22B 21/00

(52) U.S. Cl. ..... 75/709; 75/604; 75/684; 75/414; 164/123; 164/412; 164/57.1; 420/590

(58) Field of Search ..... 164/134, 122.1, 164/123; 75/709, 604, 684

(56) References Cited

U.S. PATENT DOCUMENTS 3,635,279 A * 1/1972 Matsunaga et al. ..... 164/49
3,837,842 A * 9/1974 Tanoue et al. ..... 75/58
4,033,762 A * 7/1977 Sato ..... 75/709
4,106,905 A * 8/1978 Schmitt et al. ..... 21/60.5 R
4,362,559 A * 12/1982 Perez et al. ..... 75/53
4,430,121 A * 2/1984 Shima ..... 75/96
5,279,639 A * 1/1994 Kemeny et al. ..... 75/309
6,035,924 A * 3/2000 Graham ..... 164/122.1
6,085,827 A * 7/2000 Hugo ..... 164/122.1

OTHER PUBLICATIONS

Metals Handbook, 9th Edition, Vol. 15, Davis et al., ASM International, p. 374–375.*

* cited by examiner

*Primary Examiner*—M. Alexandra Elve
*Assistant Examiner*—Kevin McHenry
(74) *Attorney, Agent, or Firm*—Cherskov & Flaynik

(57) ABSTRACT

A method to minimize oxidation of metal during melting processes is provided, the method comprising placing solid phase metal into a furnace environ-ment, transforming the solid-phase metal into molten metal phase having a molten metal surface, and creating a barrier between the surface and the environment. Also provided is a method for isolating the surface of molten metal from its environment, the method comprising confining the molten metal to a controlled atmos-phere, and imposing a floating substrate between the surface and the atmosphere.

17 Claims, 1 Drawing Sheet

METHOD TO DECREASE LOSS OF ALUMINUM AND MAGNESIUM MELTS

CONTRACTUAL ORIGINS OF THE INVENTION

The United States Government has rights in this invention pursuant to Contract No. W-31-109-ENG-38 between the U.S. Department of Energy and the University of Chicago representing Argonne National Laboratory.

BACKGROUND OF THE INVENTION

1. Field of the Invention

This invention relates to methods for decreasing oxidative melt loss of aluminum and magnesium melts and, more particularly, this invention relates to methods for providing inert physical and physico-chemical barriers to melt oxidation in aluminum and magnesium processing.

2. Background of the Invention

Almost all aluminum is melted and cast during its life cycle. During the melting process, significant aluminum loss occurs due to oxidation at the surface. Melting furnaces are large objects (3m×5m×5m high). Typically, they have side doors that allow a front-end loader to drop scrap aluminum into the furnace. Alternatively, the scrap is loaded through a removable roof into the hot furnace.

During loading, the furnace often contains some molten aluminum (called the heel). This facilitates melting of the scrap aluminum, which takes several hours. However, when the chemistry of the bath needs to be modified, a heel is not utilized and loading occurs in ambient temperature.

Once the scrap aluminum is melted, any aluminum oxide (called "dross") formed on the molten aluminum surface is physically scraped off or otherwise removed. The molten aluminum is then transferred to a holding furnace and then passed through several filters to remove entrained alumina. Finally, the filtered aluminum is cast.

When primary ingot is melted to form products, the surface of the melt starts to oxidize. Typically the losses from this operation are about 5 percent. The kinetics of this oxidation behavior of aluminum alloys are well-known and the initial growth is characterized by a period of slow growth that is two-dimensional (2-D), or amorphous, followed by a period of rapid growth characterized as three-dimensional (3-D), or crystalline.

Material lost during aluminum and magnesium processing typically takes three forms in the furnace:

1.) Dross, a mixture of aluminum oxide compounds and aluminum metal typically skimmed from the surface of the melt;

2.) Inclusions entrained in the molten metal and removed by filtration; and

3.) Oxide sludge found at the bottom of the melt.

The amount of aluminum that is lost as dross depends on many factors, such as furnace operation (e. g., temperature, atmosphere, stirring, etc.) and the specific surface area, alloy composition, and cleanliness of the input feed. The annual net amount of aluminum lost as dross totals in the vicinity of more than 330,000,000 pounds. Because aluminum requires approximately 13 kWh per kilogram to produce from bauxite, this metal loss represents an equivalent energy loss of nearly 2,000 MWh (12.5 trillion Btu/yr).

Present methods for decreasing aluminum and magnesium melt losses have several drawbacks. For example, beryllium or boron can be added to the aluminum alloy melt.

As little as 0.01 wt. percent beryllium can inhibit the oxidation of a 3.5 wt. percent magnesium alloy of aluminum for at least 46 hours at 800° C. Without the beryllium, "breakaway" oxidation can occur. However, the formation of an oxide IB film in the form of crystalline magnesium aluminate can overcome the protective action of even 0.01 weight percent beryllium in this same alloy at 800° C. C. N. a-Cochran et al.,"Oxidation of Aluminum-Magnesium melts in Air, Oxygen, Flue Gas, and Carbon Dioxide," Metallurgical Transactions B, Vol 8B, June 1977, pp.323–332.

The use of boron in melt scenarios also stymies aluminum and magnesium oxidation, as discussed in D. L. Belitskus, "Effect of $H_3BO_3$, $BCI_3$, and $BF_3$ Pretreatments on Oxidation of Molten Al-Mg Alloys in Air," Oxidation of Metals, Vol. 8, No. 5, 1974, passim. Unlike beryllium, boron does not preferentially oxidize from the alloy to concentrate in the surface film. Boron can be used in the form of $H_3BO_3$ (dusting on sample surface), dipping of sample in aqueous $H_3BO_3$, or by passing $BCI_3$ over the sample's surface.

Notwithstanding the foregoing, both beryllium and boron have toxicity problems which require special training and processing considerations.

A need exists in the art for a method to significantly reduce oxidative losses from dross formation in remelts of aluminum and magnesium ingots. Such a method would employ a physical or chemical-physical barrier to greatly diminish the annual metal losses which presently occur, along with the concomitant energy losses. The method would also employ micro-alloying elements which have little or no toxicity as opposed to beryllium and boron.

SUMMARY OF THE INVENTION

An object of the present invention is to provide a method of decreasing oxidative melt loss during secondary aluminum and magnesium production processes that overcomes many disadvantages of the prior art.

Another object of the present invention is to provide a method for forming protective films on aluminum and magnesium melts during melt processes. A feature of this invention is the coherent growth, in situ, of a thin, defect-free film that is a barrier to further oxygen transport. An advantage of the invention is that the resulting thin dross films exhibit significantly reduced oxygen diffusion rates.

Still another object of the present invention is to provide a method for creating a physical barrier between the surface of molten metal and the environment during metal processing. A feature of the invention is floating discrete entities (such as hollow spheres) of inert, low density materials on the melt surface. An advantage of this invention is that the spheres would limit oxide growth.

Another object of the present invention is to provide a method for extending the nucleation time for three-dimensional oxide growth beyond the typical industrial melt and pour cycle time in metal production processes. A feature of the invention is that the entities floating in the melt reduce melt surface exposure to the furnace atmosphere. An advantage of the invention is that the low-growth-rate incubation period of dross growth is extended beyond the melt cycling time without significantly affecting loading and melting operations. An additional advantage of this invention is a reduction in energy loss which would otherwise occur due to the oxidation.

Still another object of the present invention is to provide methods for decreasing oxidative melt loss during secondary aluminum and magnesium processes. A feature of the invention is to utilize minor alloying constituents, including, but not limited to, lithium, magnesium (for aluminum processing), calcium, and sulfur in combination with solid-phase and inert floatable materials to facilitate the selective formation of compounds on the surface of the melts to reduce-aluminum and Mg oxidation. An advantage of this invention is that both physical and non-toxic physico-chemical mechanisms are utilized to stymie unwanted oxidation of the metal being processed.

Yet another object of the present invention is to provide a method for using both alloying and minor elements during aluminum secondary processing operations to grow well-defined oxides as barriers to further oxidation of aluminum products. An feature of this invention is that the imposition of a physical barrier between the melt surface and furnace atmosphere, combined with suitable alloying element concentrations, facilitates the growth of coherent, lattice-matched oxide films whose defect free nature reduces transport of melt components to the surface layer of the growing dross film. An advantage of the invention is the minimization of three-dimensional oxide growth and preventing the oxide from extending through the depth of the aluminum melt.

Briefly, the invention provides a method to minimize oxidation of metal during melting processes, the method comprising placing solid phase metal into a furnace environment; transforming the solid-phase metal into molten metal phase having a molten metal surface; and creating a barrier between the surface and the environment.

The invention also provides a method for isolating the surface of molten metal from its environment, the method comprising confining the molten metal to a controlled atmosphere; and imposing a floating substrate between the surface and the atmosphere.

BRIEF DESCRIPTION OF THE DRAWING

The invention together with the above and other objects and advantages will be best understood from the following detailed description of the preferred embodiment of the invention shown in the accompanying drawing, wherein.

DETAILED DESCRIPTION OF THE INVENTION

Figure 1:
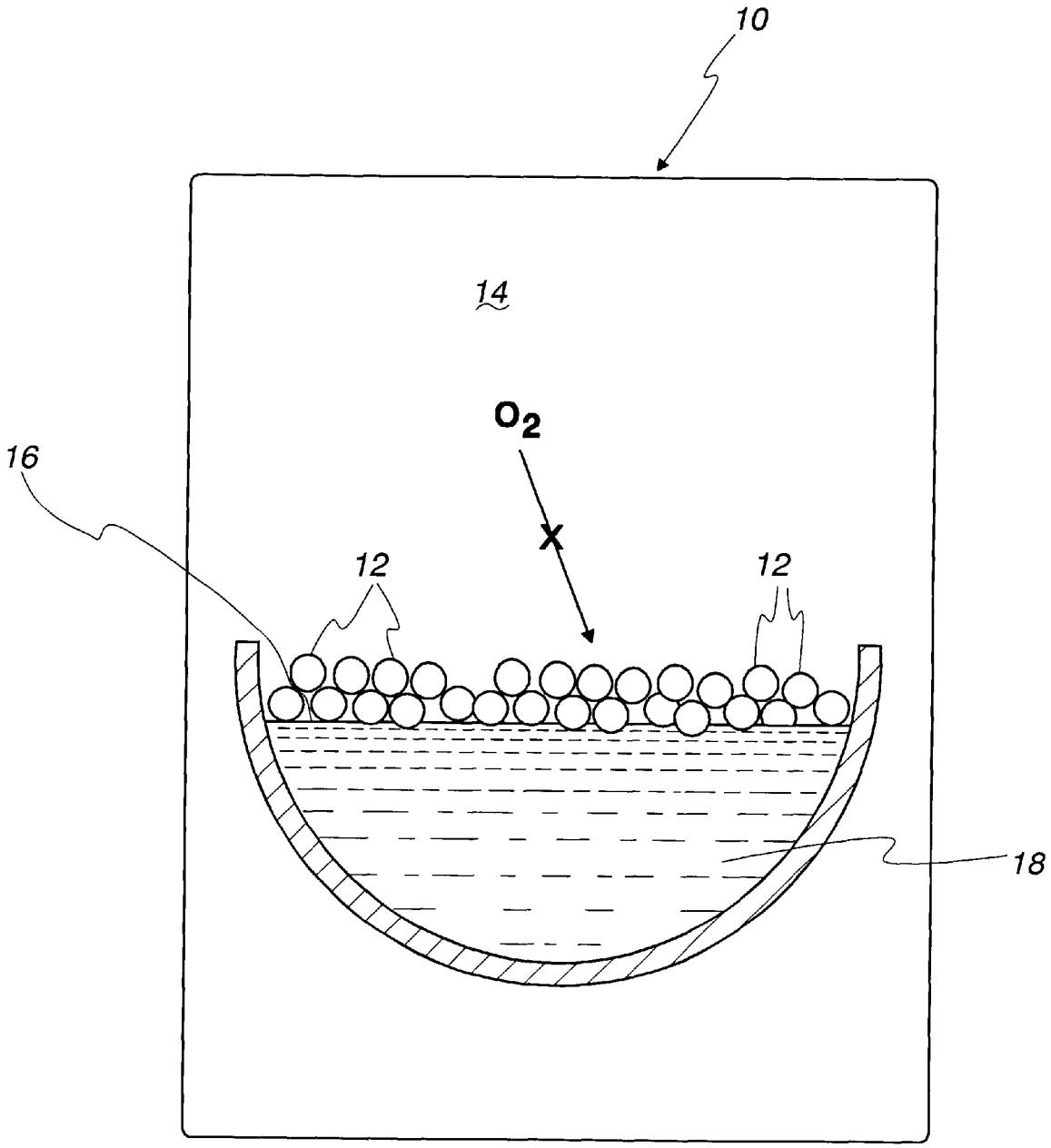
FIG. 1 is a depiction of solid-phase barriers on the surface of the aluminum melt, in accordance with features of the present invention.

This invention would be utilized by the secondary aluminum producers that take aluminum ingot and melt it to form aluminum products such as architectural hardware. Primary producers or recyclers also may utilized the invented method.

The invented method is utilized to control dross growth in melt processing environs. Dross growth seems to be at least bi-phasic with a rapid increase in film growth accompanying a change in oxide film structure from "amorphous" to "crystalline". Alternatively this change in growth rate has been described as nucleation of three-dimensional growth following a slower two-dimensional growth phase. Extension of this incubation time for change from 2-D crystalline growth to 3-D crystalline growth beyond the time typically used in an industrial melt and pour cycle would at once dramatically reduce oxidation losses, extend recycling times, reduce industrial wastes, and decrease the energy requirements of the semi-fabricated sector of the aluminum industry.

The invented method extends the 2-D structure formulation process (i.e., the amorphous phase formulation period) in aluminum or magnesium melt scenarios for a time sufficient to complete the pour process without experiencing any 3-D growth. This invention teaches that in order to extend the 2-D growth period, the surface aluminum oxide layer must be either controlled or selectively modified.

Specifically this invention provides an inert physical barrier, or a physicochemical structure to prevent or minimize oxidation during melt scenarios. The physical barrier is comprised of a solid material that is inert under the furnace environment and floats on the molten metal surface. It slows, minimizes and otherwise prevents the flow of oxidizing gas to the melt surface, thereby delaying the onset of the transition from 2-dimensional to 3-dimensional dross (oxide film) a growth beyond the typical melting time of the furnace. Thus the solid barrier material both reduces the loss to dross and reduces the amount of entrained oxide particles.

A schematic depiction of the method is illustrated as numeral 10 in FIG. 1. Generally, a plurality of floatable substrate material 12 is utilized as a barrier between an oxidizing furnace environment 14 and a surface 16 of molten metal 18.

The substrate material 12 is juxtaposed to the surface 16 as a single layer, or as multiple layers as shown. A determinant in layer numbers is whatever is necessary to minimize contact between the oxidizing atmosphere of the furnace to the melt. As such, the size of substrates and their ability to "nest" or otherwise interlock with each other will determine the amount of floating substrate utilized. Generally, at least 50 percent of the entire melt surface should be contacted with floating substrate. Preferably, substantially the entire melt surface should be contacted with the substrate.

The plurality of solid-phase floatable substrate material 12 is depicted as spherical in FIG. 1. However, and as discussed infra, a myriad of different substrate shapes can be utilized. Furthermore, as opposed to utilizing just one shape of floatable solid-phase, different sizes and/or shapes are utilized simultaneously. Alternatively, the inert material is configured as a fine or coarse powder or aggregate to effectuate melt-surface isolation. In this instance, the aggregate or powder is maintained at the melt surface 16 via surface tension. Generally, the substrates remain at the surface of the melt due to either their having a lower density than the melt, or due to the surface tension embodied by the surface 16 of the melt.

The solid barrier material might be any material that is inert under furnace conditions. As such, refractory oxides selected from the group consisting of alumina, titania, lithium oxide, silica, zeolites (alumina silicates), magnesia, calcia, and combinations thereof are suitable.

Refractory nitrides selected from the group consisting of aluminum nitride, silicon nitride, titanium nitride, boron nitride, and combinations thereof are also suitable solid-phase floatable constituents.

Refractory carbides selected from the group consisting of titanium carbide, silicon carbide, zirconium carbide, iron carbide, lithium carbide, chromium carbide, and combinations thereof can be used as solid-phase floatable constituents.

Alternatively, the barrier material is comprised of part inert material homogeneously mixed with alloying or minor moieties. As in above, these alloying or minor moieties react with oxygen or with each other to form well-defined compounds. These resulting compounds provide barriers to oxidation of the aluminum or magnesium being processed. The alloying or minor moieties are added to the surface of the melt concomitant with the addition of the inert solid substrates. Alternatively, the alloying or minor moieties are adhered to an external surface of the solid substrate prior to the later's contact with the melt surface.

In yet another alternative, the alloying or minor moieties are homogeneously mixed with the constituent material of the solid-phase substrate in a weight ratio sufficient to compromise the "inert" characteristics of the solid substrate. This will provide a time-release of the alloying or minor moieties as the constituent material degrades in the melt, at the same time the bulk constituent material confers an immediate and continuous physical barrier between the melt and the furnace atmosphere. Subsequent filtering of the molten aluminum is utilized (as discussed supra for removal of entrained alumina particles) to remove the remnants of the inert solid phase.

The floating-solid substrates also can be comprised solely of the alloy or minor moieties responsible for producing protective oxides. In this scenario, the floating substrate confers an immediate physical barrier upon establishment of the melt. Over time, this floating barrier substrate will diminish and be supplanted by the protective oxide it produces. This obviates the need to strain, filter, or otherwise remove any inert material from the melt prior to its storage or transport downstream to holding furnaces.

Melt Processing Detail

The requirement for floating of the bulk solid inert material arises from typical melting operations. Generally, the solid-phase barrier materials are present in the furnace during the same time that melting of the target metal is occurring. Preferably, the solid-phase inert material is present in the furnace before or at least at the point of melting of the introduced scrap metal.

After a typical metal processing period, the barrier material and any residual dross is removed using the tools, noted supra, currently employed for removing the dross.

Buoyancy of the solid-phase material 12 can be achieved by choosing lowdensity materials such as lithium oxide or zeolites. However, and as noted supra, the solid-phase materials can have a higher density than melted aluminum due to that element's high surface tension.

Alternatively, buoyancy can be achieved by shaping the solid-phase materials in the form of hollow spheres, ovoids, planar substrates, rods, or other convenient shapes. In the instance where spheres are utilized, golf-ball size configurations are suitable for easy extraction/manipulation with existing dross-removing tools.

Any solid-phase substrates which are inert in typical melting furnace atmospheres are suitable materials. Furnace temperatures are typically 650° C. in the melt. Heating in such scenarios is largely radiant, with the top of the furnace and the walls significantly hofter than the melt.

Thermal Conductivity Enhancement Detail

In metal process furnaces, the payload derives much of its heat from radiation off the walls and ceiling of the furnace. However, aluminum melt is shiny and typically reflects much of the heat in the furnace.

An advantage of the invention is that the invented floatable materials have low emissivity and high radiative absorption in order to balance any loss of convective heating. As a result, the radiative heating of the melt pool is significantly enhanced in this process. In essence, the floatables serve a secondary function of increasing melt temperatures by minimizing reflectance by the melt of heat.

However, the invented barrier also enhances thermal conductance in situ. Thermal conductivity is also important to overcome losses due to the high melt albedo, and also due to the virtually empty head space between the radiating ceiling and melt surface. Doping the solid-phase substrate and/or the alloy or minor moieties with electrically semiconducting materials or thermally conducting materials enhances the thermal conductivity of the barrier layer. As such, dopants consisting of multi-valent elements and transition elements are suitable to enhance thermal conductivity. Exemplary elements include boron, aluminum, copper, iron, chrome and manganese. Carbides are preferable here with a carbide/oxide composite achieving the required thermal conductivity and density.

Alternatively, a combination of different substrate sizes are utilized to enhance conductivity of the barrier layer. Larger substrate sizes, i.e., larger spheres, confer larger heating surfaces with which to transfer heat, radiating from above, to the melt in which the substrate is floating. Variable substrate sizes leads to enhanced heat transfer. "Packing" of substrate increases when various sizes are utilized simultaneously. This increased packing confers greater heat transfer and also serves as a more efficient barrier between an oxidizing furnace atmosphere and the melt surface.

In summary, the method provides a floating substrate which reduces the contact between growing dross film and furnace atmospheres. The substrate also reduces the contact between unoxidized target metal (e.g. aluminum and magnesium) and the melt atmosphere. A third advantage of the invented method is that the invented barrier substrate confers greater heat transfer from furnace surfaces to the melt. Secondarily, the substrates are of low emissivity and high radiative absorption. The floatable substrate is reusable in that it can be subjected to multiple heat cycles before being replaced.

While the invention has been described with reference to details of the illustrated embodiment, these details are not intended to limit the scope of the invention as defined in the appended claims.

The embodiment of the invention in which an exclusive property or privilege is claimed is defined as follows:

1. A method to minimize oxidation of metal during melting processes, the method comprising:

a) placing solid-phase metal into a furnace environment;

b) transforming the solid-phase metal into molten metal phase having a molten metal surface;

c) floating thermally conductive spheres on the surface, wherein the spheres are comprised of alloying constituents coating spheres of inert material; and d) allowing the constituents to form compounds on the molten metal surface while the spheres of inert material provide a physical barrier between the surface of the molten metal and the furnace environment.

2. The method as recited in claim 1 wherein the step of creating a barrier further comprises modifying the surface by adding chemical moieties to the metal phase to produce oxide barriers.

3. The method as recited in claim 1 wherein the inert material is a refractory oxide selected from the group consisting of alumina, titania, lithium oxide, silica, zeolites, magnesia, and combinations thereof.

4. The method as recited in claim 1 wherein the inert material is a refractory nitride selected from the group consisting of aluminum nitride, silicon nitride, titanium nitride, boron nitride, and combinations thereof.

5. The method as recited in claim 1 wherein the inert material is a refractory carbide selected from the group consisting of titanium carbide, silicon carbide, zirconium carbide, iron carbide, chrome carbide, lithium carbide and combinations thereof.

6. The method as recited in claim 1 wherein the spheres are added during the transformation step.

7. The method as recited in claim 1 wherein the constituents contain lithium, or magnesium, or calcium, silicon, or sulfur.

8. The method as recited in claim 2 wherein the moieties are present in the melt at a weight percent of at least 0.01.

9. The method as recited in claim 1 wherein the step of transforming the solid metal phase to molten metal further comprises heating the metal from a point above the metal.

10. The method as recited in claim 1 wherein the alloying constituents are lithium or magnesium, or calcium or sulfur.

11. The method as recited in claim 10 wherein the alloying constituents are doped with multi-valent elements and transition elements to enhance thermal conductivity.

12. A method for isolating the surface of molten metal from its environment, the method comprising:

a) confining the molten metal to a controlled atmosphere;

b) imposing a thermally conductive, floating substrate between the surface and the atmosphere, wherein the floating substrate comprises spheres of inert material coated with alloying constituents; and c) allowing the constituents to form compounds on the molten metal surface while the spheres of inert material provide a physical barrier between the surface of the molten metal and the controlled atmosphere.

13. The method as recited in claim 12 wherein the floating substrate comprises a chemical moiety which forms an oxide in the controlled atmosphere.

14. The method as recited in claim 12 wherein the floating substrate has a higher density than the molten metal.

15. The method as recited in claim 12 wherein the molten metal is heated from a point above the molten metal.

16. The method as recited in claim 12 wherein the alloying constituents are lithium or magnesium, or calcium or sulfur.

17. The method as recited in claim 16 wherein the alloying constituents are doped with multi-valent elements and transition elements to enhance thermal conductivity.

* * * * *